United States Patent [19]

Austin

[11] Patent Number: 5,029,518

[45] Date of Patent: Jul. 9, 1991

[54] MODULAR CLEAN ROOM STRUCTURE

[75] Inventor: Frank X. Austin, Plymouth, Mich.

[73] Assignee: Clean Air Technology, Inc., Canton, Mich.

[21] Appl. No.: 421,824

[22] Filed: Oct. 16, 1989

[51] Int. Cl.[5] ..... F24F 7/013

[52] U.S. Cl. ..... 98/31; 52/464

[58] Field of Search ..... 98/31; 52/464, 468, 52/459

[56] References Cited

U.S. PATENT DOCUMENTS

| | | | |
|---|---|---|---|
| 2,131,268 | 9/1938 | Boes | 52/464 X |
| 2,220,690 | 11/1940 | Stupakoff | 52/464 X |
| 2,394,443 | 2/1946 | Guignon, Jr. | 52/468 X |
| 3,158,457 | 11/1964 | Whitfield | 55/472 |
| 3,771,277 | 11/1973 | Rausch et al. | 52/468 |
| 3,789,747 | 2/1974 | Wasserman et al. | 98/31 |
| 3,986,850 | 10/1976 | Wilcox | 98/33 R |
| 4,269,006 | 5/1981 | Larrow | 52/79.1 |
| 4,272,930 | 6/1981 | Foster | 52/79.1 |
| 4,489,645 | 12/1984 | Sirch | 98/36 |
| 4,603,618 | 9/1986 | Soltis | 98/31.5 |
| 4,655,011 | 4/1987 | Borges | 52/79.1 |
| 4,667,579 | 5/1987 | Daw | 98/33.1 |
| 4,671,811 | 6/1987 | Cadwell | 55/355 |
| 4,693,173 | 9/1987 | Saiki | 98/31.5 |
| 4,693,175 | 9/1987 | Hashimoto | 98/31.6 |
| 4,699,640 | 10/1987 | Suzuki | 55/385 A |

OTHER PUBLICATIONS

Clean Air Technology, Inc., Publication Reference Apr., 1988.

*Primary Examiner*—William E. Tapolcal

*Attorney, Agent, or Firm*—Harness, Dickey & Pierce

[57] ABSTRACT

A modular clean room load bearing structure having a negative air pressure plenum above the clean room ceiling to prevent the collection of dust and dirt above the ceiling. The vertical sidewall of the clean room is constructed of individual wall modules which are assembled together on site to construct the clean room. Each wall module serves as a return air duct for circulating air from the clean room upwardly through the wall module to the negative pressure plenum where the air is drawn out to a HVAC unit for conditioning the air. The conditioned air is returned to the clean room through a supply air duct system which includes HEPA filters in the clean room ceiling which filter the air immediately prior to the air being blown into the clean room. A support deck spans across the top of the sidewall and is formed by four foot wide structural panels spanning across the clean room. The deck supports the HVAC equipment above the deck while the clean room ceiling and HEPA filters are suspended from the deck. The total assembled clean room structure provides all of the required clean room features plus structural capabilities with a finished, aesthetically pleasing look.

4 Claims, 4 Drawing Sheets

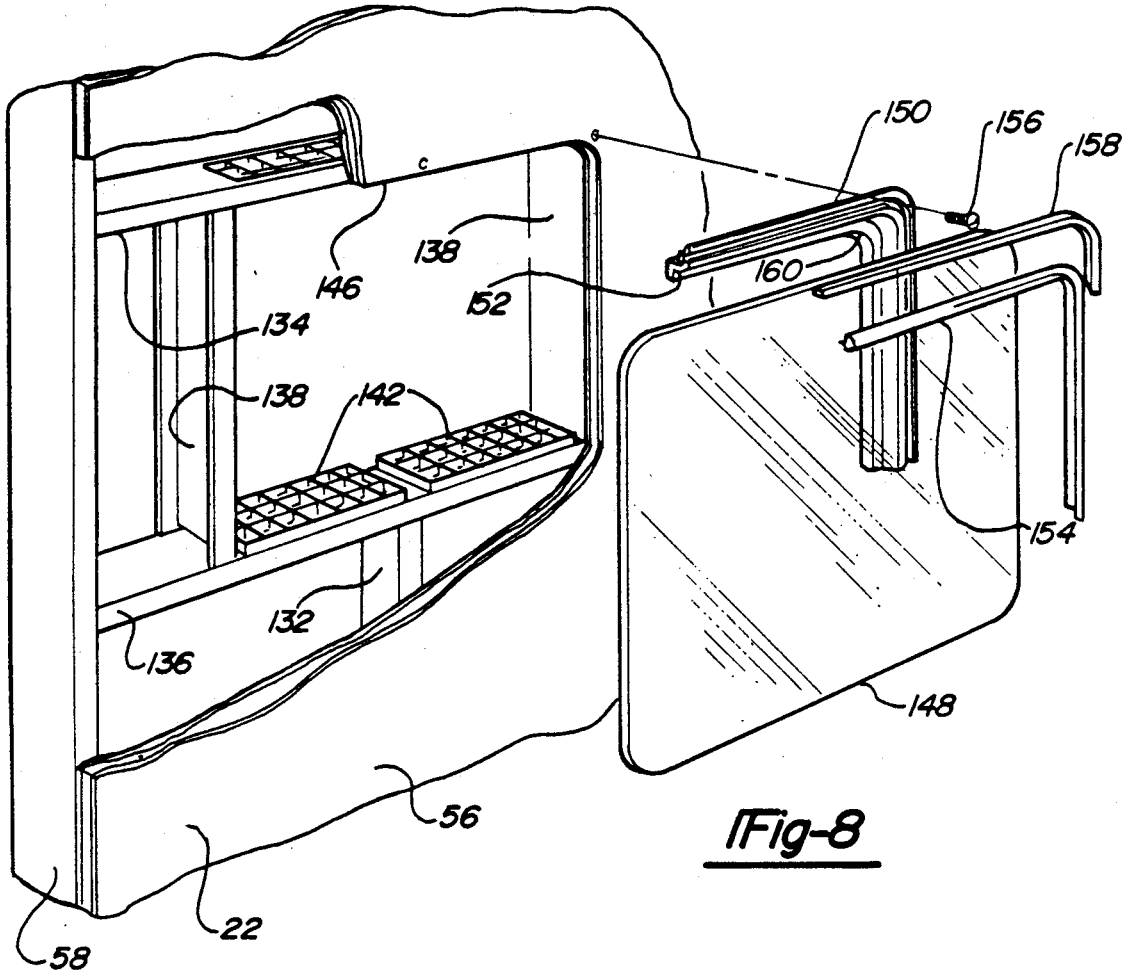
Fig-8
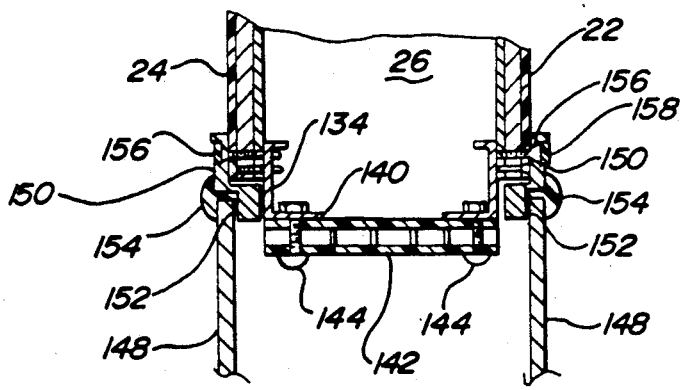
Fig-9
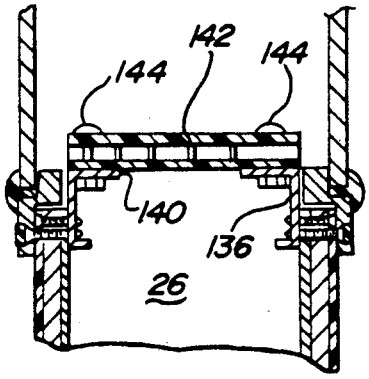

MODULAR CLEAN ROOM STRUCTURE

BACKGROUND AND SUMMARY OF THE INVENTION

The present invention relates to a clean room and more particularly to a modularly constructed load bearing clean room structure having a negative air pressure plenum above the ceiling of the clean room to improve the efficiency of the clean room.

The need for a controlled, contaminant free work area is well recognized in industry and in particular in the semi-conductor industry. Accordingly, specialized clean rooms have been developed which provide a controlled environment in which precise assembly and manufacturing operations can be performed with minimal contamination by air borne particles. The atmosphere in a clean room is typically purified from particle contaminates by the use of high efficiency particle air (HEPA) filters In the construction of a clean room it is desirable to provide an air flow system which occupies a minimal amount of space while providing the necessary ventilation functions. It is also desirable that the top of the clean room be a structural deck to serve as a mechanical equipment platform and the walls be strong enough to support the deck. It is also desirable to provide a clean room structure which can be quickly assembled at a user's production facility such that the operation of a production facility is interrupted as little as possible during the construction of a clean room. This is particularly important during an expansion of an existing clean room. In addition, during such an expansion, it is desirable to reduce, as much as possible, the amount of dust or dirt generated during the construction of the clean room addition. It is further desirable to construct a clean room in which dust or other contaminates are prevented from collecting on the clean room ceiling which, over time, can work into the clean room environment.

The clean room is of a modular structure which can be prefabricated off-site and assembled at the production facility of the clean room user. Off-site fabrication of the clean room enables the clean room to be assembled using a minimal amount of time and construction space and creating a minimal amount of dust and dirt. The clean room of the present invention includes wall modules having a four foot width that are assembled in a side by side relationship to construct the sidewall of the clean room. The interior of the wall modules serve as air return ducts for the recirculation of the clean room air. Across the top, or spanning the clean room walls, a support deck is constructed using four foot wide deck panels from which downwardly suspends a clean room ceiling structure. Air conditioning and other HVAC equipment is mounted on the top of the support deck. The space between support deck and the clean room ceiling is in communication with the return air side of the HVAC equipment such that the air pressure in this space is less than the atmospheric pressure creating a negative air pressure plenum above the clean room ceiling. The plenum is in communication with the return air ducts in the sidewall modules to draw air from the return air ducts. Air from the clean room enters into the sidewall modules through vents at the base of the sidewall modules. Conditioned air is then returned from the HVAC system through air ducts to a plurality of HEPA filters in the clean room ceiling which filters the conditioned air immediately prior to the air being blown into the clean room interior.

The negative pressure plenum above the clean room ceiling eliminates the accumulation of dust and dirt above the clean room such that over time, no dust or dirt will collect which can infiltrate the clean room environment. This helps to guarantee that cleanliness specifications will be met over the useful life of the clean room. The use of the sidewall modules as return air ducts reduces the space required for the return air system to a minimum and eliminates exposed sheet metal duct work. All of the wall modules serve as air ducts so that even air circulation in the clean room is provided. The modular construction of the clean room enables the individual wall and deck panels to be prefabricated off-site and merely assembled together to form the clean room using a minimal amount of time and creating a minimum of dust and dirt.

The present invention relates to certain improvements in the clean room structure. The wall modules are constructed from a welded framework using two C-channel galvanized steel studs at each vertical edge of the modules. Additional vertical C channel studs are used inside the perimeter framework depending on strength required. An aluminum or steel lined composite panel is placed on the interior and exterior sides of the studs which serve as the interior and exterior surfaces of the clean room wall. The aluminum or steel is first bonded to the composite panel before the panel is secured to the welded frame work. The space between the panels forms the return air duct in the sidewall modules. The depth of the vertical C channel studs is determined by the amount of air required. The sidewall is assembled by placing the modules together with studs of each module abutting a stud of an adjacent module. Each modular panel is a sealed one piece assembly.

The width of the composite panels is slightly less than the width of the welded framework so as to form a gap between the panels which is filled with a flush fitting trim strip to give a finished appearance to the wall and to protect the panel core. The gap is offset from the center of the joint between modules to enable the trim strip to be secured to one of the two steel studs at each joint rather than be secured into the seam between abutting studs. The offset gap is created by attaching the panels to the studs with one vertical edge of the panel substantially flush with the stud edge and the other vertical edge of the panel recessed from the edge of the stud so as to expose the side surface to the stud.

The lower end of the panels terminate approximately one half inch above the floor so that liquid spilled on the floor will not contact and damage the panel core material. In addition, one panel of the module can terminate at the lower end approximately five inches above the floor to provide access into the module interior for fastening the module to the floor. This space between the panel and floor is filled with a cover board fastened to the studs. A cove base molding is applied to the cover board and the joint between the cover board and panel or the floor material is continuously coved up the walls to a height above the cover board.

Windows are constructed in the modules with two window panes, one pane in each panel. The panes are mounted in frames which are secured to an opening in the panels. The window frames are made of a one-piece aluminum extrusion which is bent with relatively large radius curves to form the window corners. By constructing the window frames of one-piece only one seam is created where the frame ends abut. This reduces the opportunity for contaminates to enter the clean room compared to a window frame of four separate pieces joined at each corner.

Further objects, features and advantages of the invention will become apparent from a consideration of the following description and the appended claims when taken in connection with the accompanying drawings.

BRIEF DESCRIPTION OF THE DRAWINGS

FIG. 8 is an exploded perspective view of the window construction in a wall; and FIG. 9 is a vertical sectional view through a window in a wall module wall panel.

DETAILED DESCRIPTION OF THE PREFERRED EMBODIMENT

Figure 1:
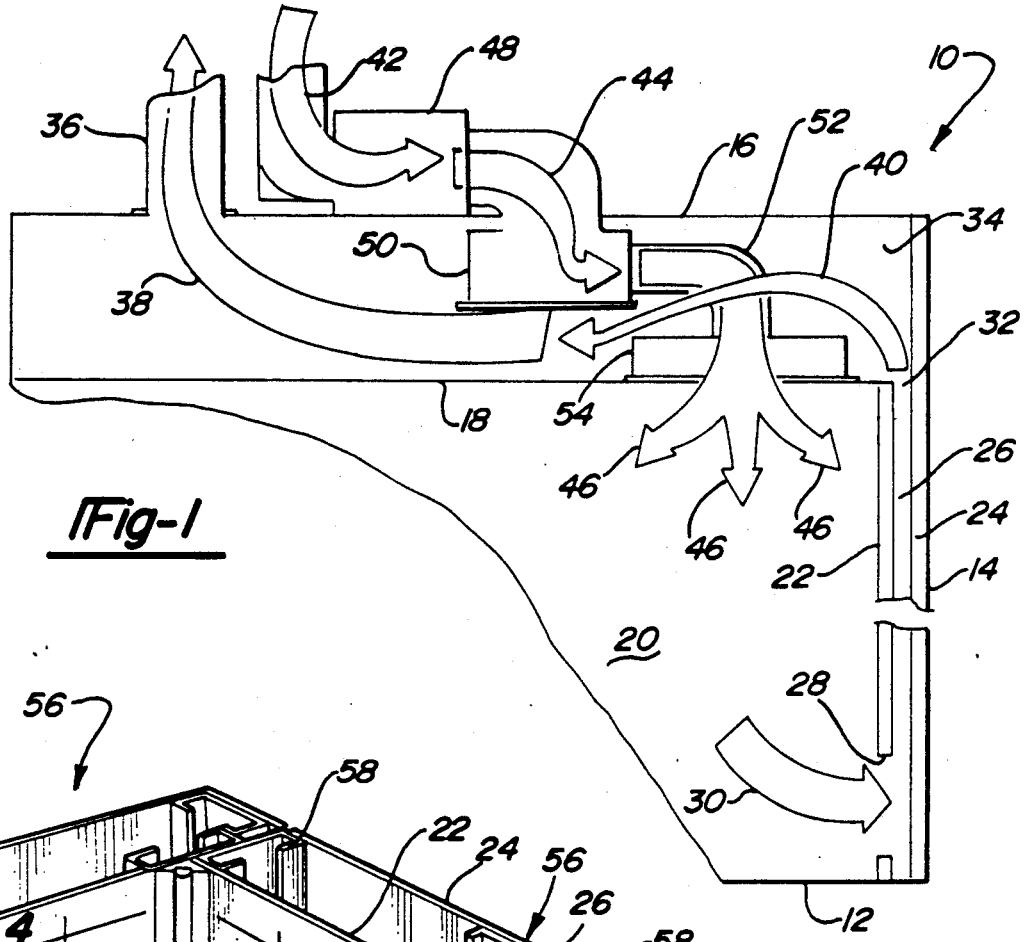
FIG. 1 is a schematic view of the clean room air circulation system.

The clean room of the present invention is shown schematically in FIG. 1 and designated generally at 10. The clean room is constructed on a floor 12 with a vertical sidewall 14 and an upper support deck 16. A ceiling 18 is suspended from the support deck 16 to define the clean room interior space 20.

The clean room sidewall 14 is constructed from a plurality of wall modules 56 which are fastened together, as described in detail below, to form the sidewall. Each one piece finished wall module includes an interior panel 22 and an exterior panel 24 which are spaced apart from one another by the fact that they are bonded and screwed to the sides of C-studs and form a return air duct 26 within the wall module. The lower end of the interior panel 22 includes an opening 28 to enable the flow of air from the clean room interior 20 into the return air duct 26 as shown by the arrow 30. The opening is typically covered by louvered return air grill (not shown). The top end 32 of the return air duct 26 is in communication with the closed space 34 between the support deck 16 and the ceiling 18. The space 34 is in communication with the vacuum side of the heating, ventilating and air conditioning system for the clean room via air duct 36. The vacuum produced by the HVAC unit draws the air from the space 34 as shown by the arrow 38 creating a negative air pressure within space 34 such that the space acts as a negative air pressure plenum above the clean room ceiling The negative pressure plenum draws air from the open top end of the wall return air duct 26 as shown by arrow 40, which in turn draws air from the clean room interior into the wall return air duct through opening 28. The negative air pressure plenum results in a continuous flow of air through the plenum such that dust or particles will not settle in the plenum or on the top of the ceiling 18. In addition, the creation of a negative air pressure plenum above the ceiling prevents any dust particles which may settle above the ceiling from penetrating into the clean room ceiling grid by gravity, vibration or opposing or positive air forces above the clean room ceiling.

The conditioned air is supplied to the clean room from the HVAC system as shown by arrows 42, 44 and 46 through a recirculating blower 48, feeder or supply air duct 50 and a flexible air duct 52 to one of a plurality of HEPA filters 54. The HEPA filters filter the conditioned air immediately prior to the air being blown into the clean room interior 20. A plurality of HEPA filters 54 are positioned in the ceiling 18.

Figure 2:
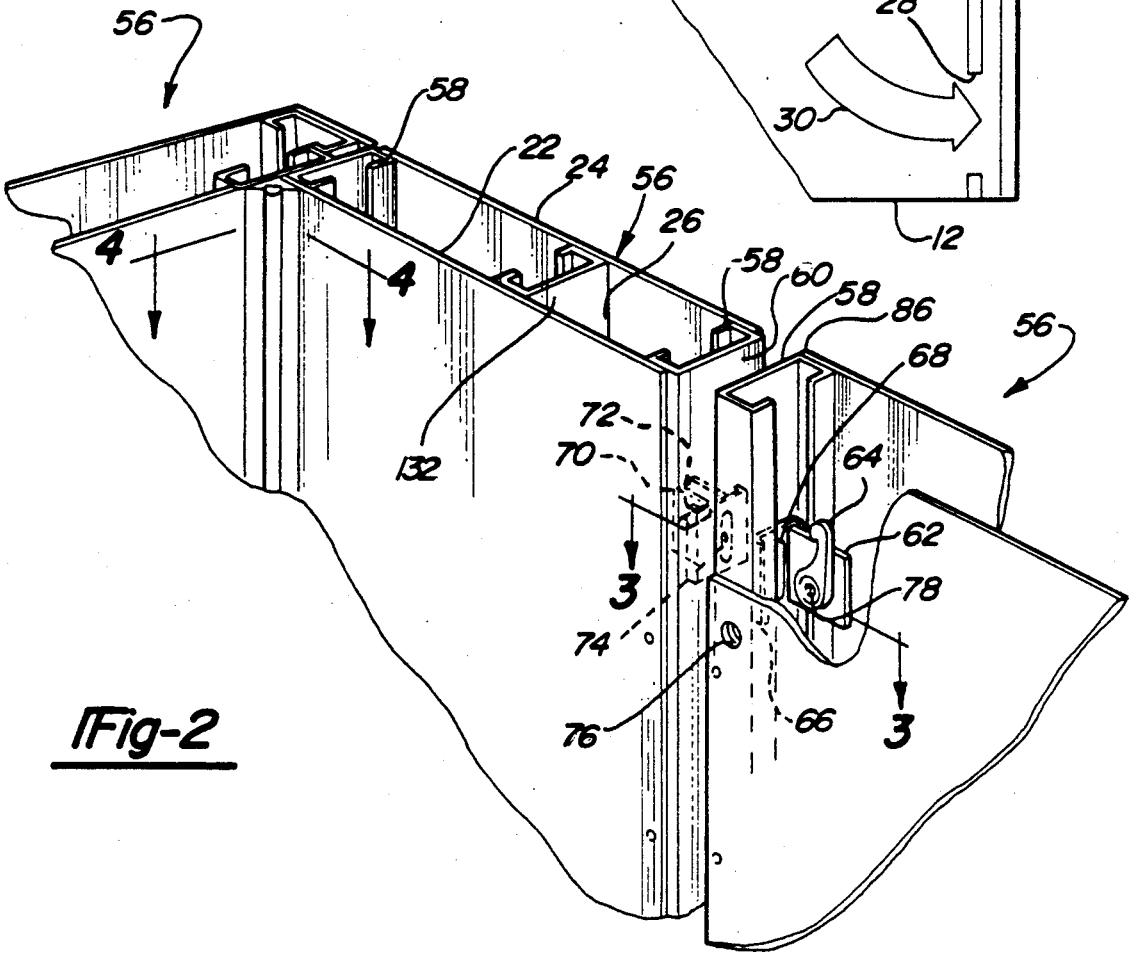
FIG. 2 is a perspective view of the sidewall modular panel construction.

With reference to FIG. 2, the detail of the sidewall modules are illustrated. The sidewall 14 is constructed of a plurality of upright modules 56 assembled in a side to side relationship to form the sidewall 14. The modules are typically four feet in width, up to 18 feet in height and between three and seven inches in thickness. Each module includes a minimum of three galvanized steel C-shaped studs 58 and 132 positioned two feet on center. The two outer studs 58 are oriented in the wall module with their open sides facing one another such that the closed side of the C-stud forms a vertical end surface 60 of the modules 56. Attached to one side of the C-studs is the interior panel 22 and attached to the outside of the C-studs is the exterior panel 24. The aluminum or metal liner of the composite panel is positioned to face to the inside of the modules. The interior space between the panels 22 and 24 and between the C-studs 58 forms the metal lined wall return air ducts 26. The third vertical C-stud 132 is generally positioned vertically in the center of the module between the two outer C-studs 58 for additional strength. The load bearing strength of the module is achieved by the continuous bonding and fastening techniques used.

The wall modules are attached together by cam lock mechanisms 62 within the interior of the wall modules. The cam lock mechanism 62 includes a rotatable hook member 64 which is attached to the inner side of a C-stud by a steel plate 66 welded to the inner side of the C-stud. The plate 66 as well as the C-stud includes a slot access opening 68. The C-stud of the adjacent wall module 56 has secured to its inner side a second plate 70 which supports a fastening pin 72 and also includes a slot access opening 74. The modules 56 are assembled by positioning adjacent modules in side-to-side relationship in which the vertical end surfaces 60 of adjacent C-studs 58 are in abutting relationship. The cam lock hook 64 is then rotated in a counterclockwise direction, as shown in FIG. 2, by a hex head wrench inserted into the module interior through access opening 76 and into the hex head socket 78 in the hook 64. When rotated into the locked position, the hook 64 extends through the slots 68 and 74 and engages the fastening pin 72 and is locked thereto to secure the two modules together. A number of cam lock mechanisms 62 are vertical spaced along the vertical ends of the modules 56 to secure adjacent modules together at several locations.

Figure 3:
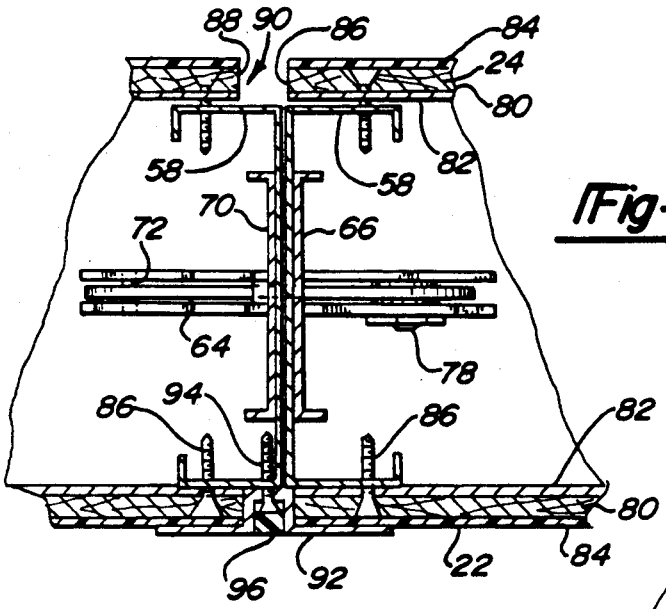
FIG. 3 is a sectional view as seen along line 3—3 of FIG. 2.

The sectional view in FIG. 3 shows the cam lock fastener in the locked position in which the hook 64 is rotated into locking engagement with the fastening pin 72. FIG. 3 further shows the construction details of the interior and exterior panels 22 and 24. The panels are of identical construction with a center core of a one half inch thick composite board An aluminum sheet liner 82 is bonded to the inner side of the particle board 80 and a general purpose grade plastic laminate 84 such as WILSONART or FORMICA is attached to the outer surface of the composite board. The aluminum sheet liner 82 is used to cover the composite board core 80. It is essential to protect the air of the clean room from direct contact with the composite material to prevent particles from the composite board from entering the air. The panels 22 and 24 are constructed by first bonding the aluminum sheet liner 82 to the composite board 80. The composite board and aluminum sheet liner are then secured to the C-studs 58 by a plurality of screws 86 along the periphery of the panels 22 and 24. A continuous bead of a construction adhesive is placed between the C-stud and the aluminum sheet liner to provide an air tight seal between the C-studs and the aluminum sheet. The plastic laminate 84 is then bonded to the exterior side of the composite board covering the screws 86.

As shown in FIGS. 2 and 3, the panels 22 and 24 are attached to the C-studs in such a manner that one vertical edge 86 of the panels 22 and 24 is positioned substantially flush with the vertical end surface 60 of the C-shaped studs 58. The opposite vertical end 88 of the panels 22 and 24, however, is recessed from the vertical end surface 60 of the C-stud 58 forming a gap 90 between the two vertical ends 86 and 88 of adjacent panels 22 and 24. The gap 90 is filled by an aluminum trim strip 92 which is inserted into the gap and overlies the peripheral edge of the outer side of the panels 22 and 24. The aluminum trim strip is necessary to cover the vertical ends 86 and 88 of the panels 22 and 24 to cover the particle board inner core and cam lock access holes and also to provide a smooth finished appearance to the wall of the clean room. The aluminum trim strip 92 is fastened to one of the C-shaped studs by a number of self tapping screws 94. The heads of the screws are covered with a black vinyl insert which fits flush with the exterior of the aluminum trim strip 92. The vertical end 88 of the panels 22 and 24 are recessed from the vertical end surface 60 of the studs while the other end 86 of the panel is flush with the end surface 60 to enable the aluminum trim strip 92 to be screwed directly into one of the abutting C-studs 58. If the two panel ends 80 and 88 were both equally offset from the end surface 60 so as to center the gap 90 with respect to the C-studs 58, the screws 94 would be driven into the joint between the two C-studs 58 and not secured as well as with the configuration shown in FIG. 3.

Figure 4:
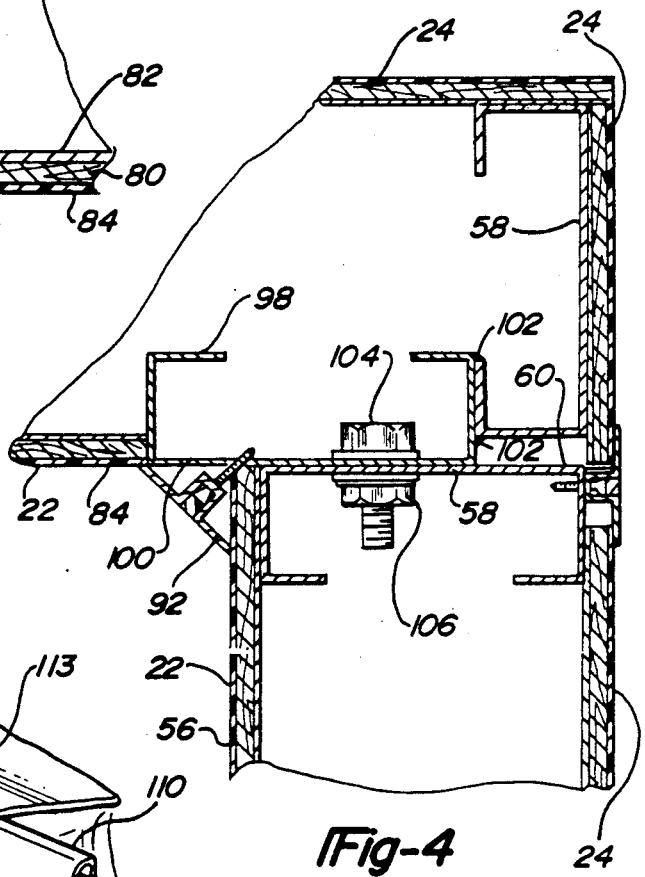
FIG. 4 is a sectional view as seen along line 4—4 of FIG. 2.

The corner construction of the vertical wall is shown in section in FIG. 4. In a corner joint, one module will include an additional C-shaped stud 98 which is positioned at a right angle relative to one of the C-shaped end studs 58 and welded thereto at 102. The end surface 100 of the C-stud 98 is positioned flush with the surface of the plastic laminate 84 of the interior panel 22. The C-stud 98 is shown attached to the vertical end surface 60 of the adjacent module 56 by a bolt 104 and nut 106. Alternatively, the C-studs 98 and 58 can be connected using a cam lock mechanism 62. The right angle interior corner between adjacent interior panels 22 is finished with a aluminum trim strip 92 like that described above secured with screws 94.

Figure 5:
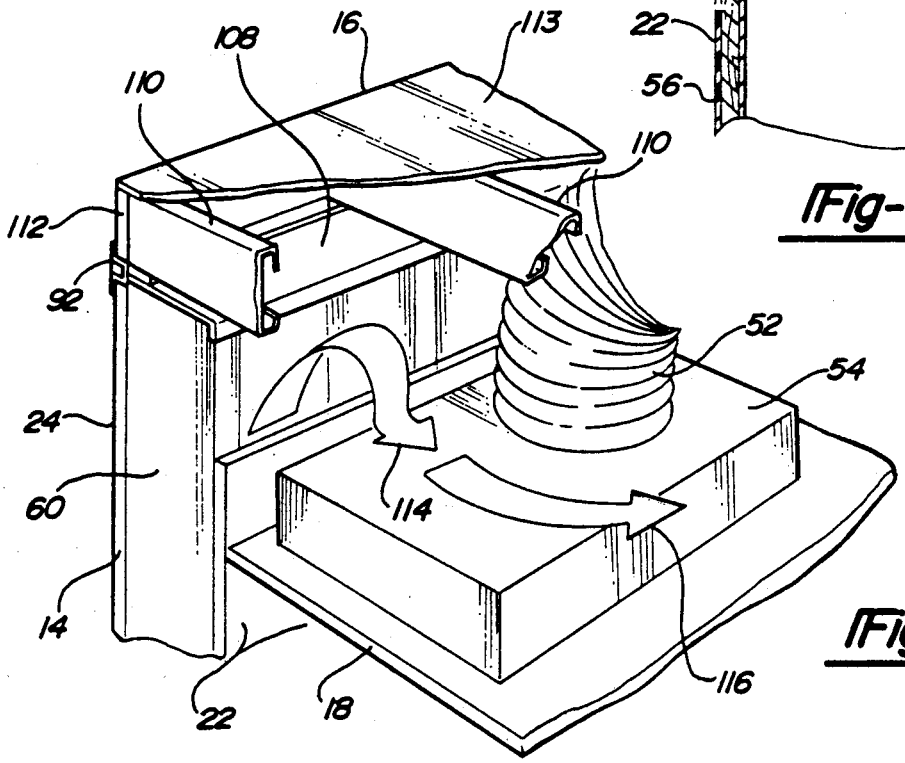
FIG. 5 is a perspective view showing the upper end of modular wall panel and the support deck.

Referring now to FIG. 5, the upper end of the wall 14 and the support deck structure 16 is shown in detail. The upper end of the wall 14 is made with a metal cap plate 108 upon which is supported the deck structure 16. The deck structure 16 includes a plurality of horizontally placed support joist 110 built into each four foot wide deck panel. The end of the deck structure is covered with a finished end board 112 which is constructed of the same composite material as the interior and exterior panels 22 and 24. Between the lower end of the end board 112 and the top of the exterior panel 24, a aluminum trim strip 92 is inserted to provide a finished appearance and to cover the composite board interior of the panel and end board. The top of the deck is finished with a panel 113 of the same composite construction as interior and exterior panels 22 and 24 with the aluminum liner bonded to the panel and facing the inside of the plenum. This is important to prevent exposed wood particle generation in the return air plenum.

Due to deck loading specifications, the thickness of the composite deck panel may vary. The deck panel is usually bonded and screwed to the deck framework. After the deck panels are positioned and secured, all seams and joints are caulked.

The interior panel 22 does not extend to the upper end of the vertical wall 14 such that the wall return air duct 26 within the wall 14 is in communication with the negative pressure plenum between the deck structure 16 and the ceiling 18 to enable air to flow from the return air duct into the plenum as shown by the arrows 114 and 116.

Figure 6:
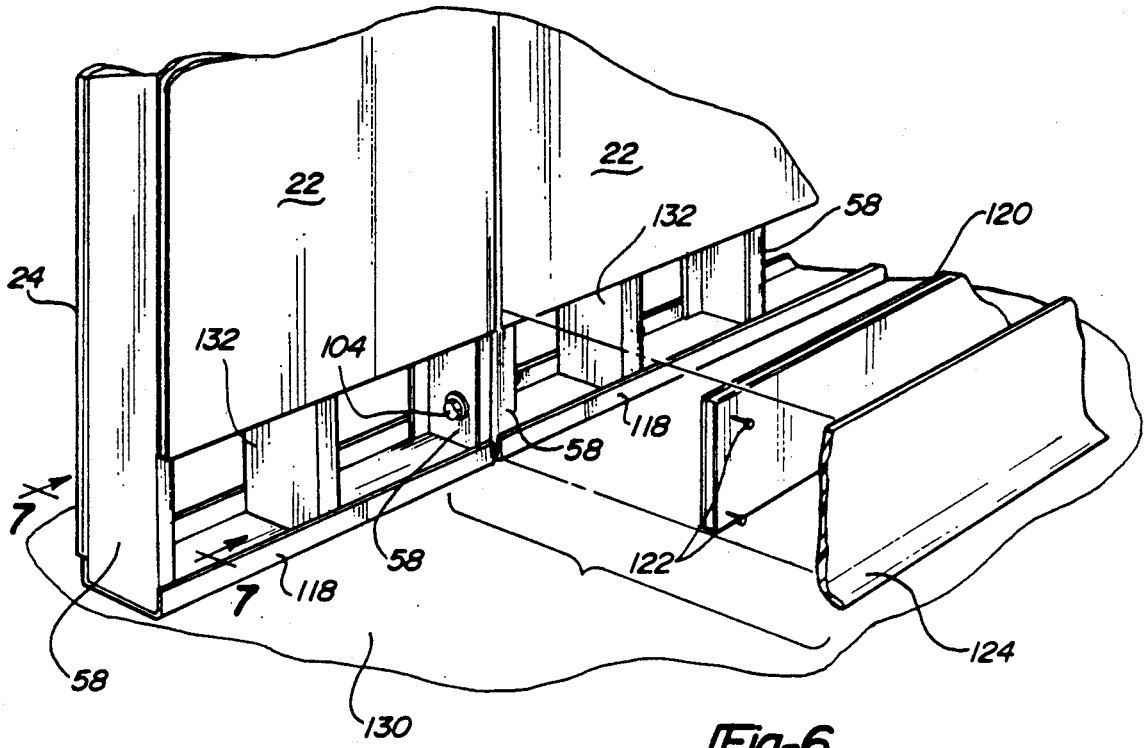
FIG. 6 is a perspective view of the construction of the lower end of the modular wall panel.
Figure 7:
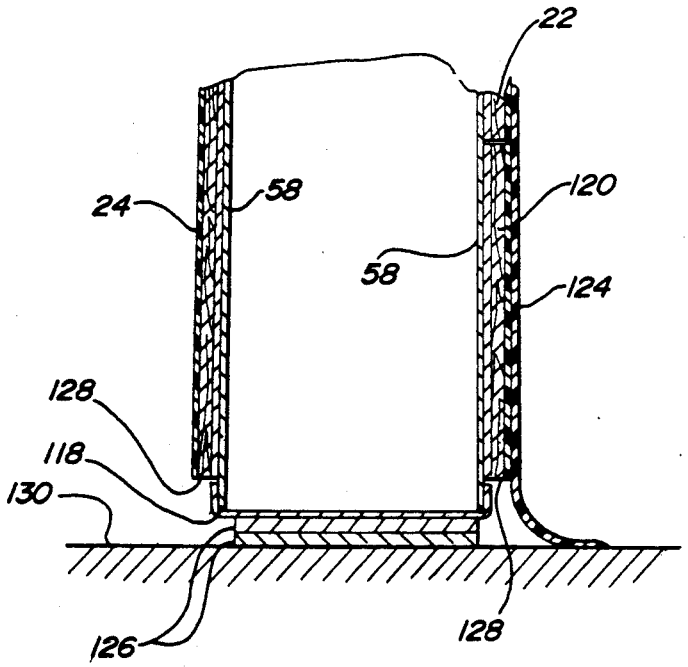
FIG. 7 is a sectional view as seen from the line 7—7 of FIG. 6.

The lower end structure of the wall 14 is shown in detail in FIG. 6. The bottom and top of the wall panel framework is formed by a metal U-shaped sill channel 118. The sill channel 118 is attached to the floor of the building in which the clean room is installed by gun driven nails. The interior panels 22 of the wall modules terminate at their lower ends approximately five inches above the end of the wall modules to provide access to the interior of the module to fasten the wall modules to the floor. Because access to the interior of the wall is provided at the lower end, the lower most attachment of the modules to one another is accomplished by blot 104 in place of the cam lock mechanism 64. Once the wall has been installed, a cover board 120 is attached to the wall to finish the wall interior and cover the access opening into the wall. The cover board 120 is of identical composite structure as the panels 22 and 24. The cover board 120 is installed by screws 122. The cover board 120, as well as the joint between the cover board and the lower end of the interior panel 22, is covered by a vinyl cove base molding 124 or continuous coved floor covering.

The sill channel 118 of the wall modules is positioned either directly upon the floor 130 of the building into which the clean room is installed or can be positioned on top of shims 126 used as necessary at the location of each C-stud to provide a level support for the wall modules. The lower ends 128 of the interior panel 22 or cover board 120 and the exterior panel 24 are spaced approximately one half inch from the floor 130. This is necessary to prevent any liquid which may spill on the floor 130 from being absorbed into the composite board core 80 and damaging the interior or exterior panels.

Windows in the vertical sidewall 14 are provided as shown in FIGS. 8 and 9. The interior window structure is shown in FIG. 8 in which the interior of the wall module includes a window frame comprised of a top horizontal window framing stud 134, a bottom horizontal window framing stud 136 and two vertical window framing studs 138. The center C-shaped stud 132 in the module 56 is interrupted by the horizontal window framing studs 134 and 136. The horizontal window framing studs 134 and 136 each have openings 140 cut therethrough to enable air to flow upwardly through the interior of the wall module through the return air duct 26. The openings 140 are covered by acrylic egg crate or louvered panels 142 which are secured to the horizontal framing studs by a plurality of bolts and nuts 144.

The interior and exterior panels 22 and 24 have window openings 146 cut therein which are covered by window panes 148 secured to the openings 146 by a frame 150. The window panes can be glass, plexiglass, LEXAN, etc. The window frame 150 includes a recessed inner portion 152 into which the glass 148 is seated. The glass is held in place in the frame 150 by a rubber retaining seal 154 around the periphery of the pane. The window frames are fastened to the panels 22 and 24 by a plurality of screws 156 which are recessed into the exterior surface of the frame 150 and covered by a black rubber cover strip 158. The double pane window in the wall modules 56 enables the flow of air upwardly through the wall return air duct 26 without interruption.

The window frame 150 is an aluminum extrusion which is bent to form relatively large radius corners 160. By providing corners 160 with a large radius, it is possible to bend the extruded frame and construct the entire frame with one piece of material. With a one-piece window frame, there is only one joint in the frame where the two ends of the frame abut one another. This reduces the possibility of contaminants entering the clean room relative to a window frame having four separate pieces along each side of the window pane with a joint.

The modular load bearing clean room structure of the present invention provides an economically produced and installed clean room having several features which improve the operation of the clean room. The negative air pressure plenum above the clean room ceiling is useful for preventing the accumulation of dust and dirt above the ceiling, which over time, could enter the clean room environment. The wall modules are constructed in a manner to provide an offset on one vertical edge of the interior and exterior panels of the module to enable a trim strip to be secured directly to one of the wall module vertical studs. In addition, the lower edge of the wall panel along the inside of the clean room terminates above the floor to provide a clearance for assembling the wall modules to the floor of the building to which the clean room is being installed. The finished panels on both the interior and exterior side of the modules terminate above the floor so as to prevent any liquid spilled on the floor from contacting the panel composite board core and damaging the core. An additional feature to improve the operation of the clean room is a window frame constructed of a single piece aluminum extrusion to provide a window frame having a single joint where the two ends of the window frame meet as opposed to a window frame having four separate members joined at the corners of the window. In addition, the clean room is designed as a total load bearing structure to provide a built-in structural load bearing platform or top deck for positioning air conditioning and other mechanical equipment and for supporting the ceiling, lights, air filters and duct work hung below. This deck also completely closes and seals off the top of the clean room and allows creation and use of the negative air plenum below.

It is to be understood that the invention is not limited to the exact construction or method illustrated and described above, but that various changes and modifications and improvements may be made without departing from the spirit and scope of the invention as defined in the following claims.

What is claimed is:

1. Modular clean room structure to form an environment isolated from ambient atmosphere to enable the air within the environment to be maintained substantially free from particle contamination comprising:

a vertical sidewall constructed of a plurality of vertical modules positioned in side to side abutting relation with one another along vertical edges of the modules, said vertical wall modules each including a pair of vertical support members with one support member at each end forming vertical end surfaces of said modules, each end surface of a module abutting an end surface of an adjacent module to form said sidewall, a pair of panel members attached to said pair of support members along vertical edges of said panel members, said panel members forming interior and exterior surfaces of the clean room sidewall, said panel members having a width less than the width of the modules so as to form a gap between the vertical edges of adjacent panel members when the modules are assembled to form said sidewall, the panel members being positioned on said support members so the gap between panel members is offset from the seam between abutting support members to enable trim means to be placed within the gap to cover the edge of the panel members and to be secured directly to one of said support members.

2. The clean room structure of claim 1 wherein the support members and panel members of a module form a return air duct within each module for circulation of air from the clean room environment.

3. The clean room structure of claim 2 further comprising means forming a negative air pressure plenum above said clean room, said plenum in fluid communication with the return air duct of each module and wherein said air ducts in said modules are in fluid communication with the clean room environment.

4. The clean room structure of claim 1 further comprising a substantially horizontal support deck across the upper end of said side wall, said deck structure being constructed of a plurality of deck modules connected together and said deck structure being capable of supporting mechanical equipment for use with the clean room above the deck structure and for supporting a clean room ceiling and air filters below the deck structure.

* * * * *